US008162161B2

(12) United States Patent
Suzuki

(10) Patent No.: US 8,162,161 B2
(45) Date of Patent: Apr. 24, 2012

(54) BOTTLE CONTAINER

(75) Inventor: Koji Suzuki, Yokohama (JP)

(73) Assignee: Fancl Corporation, Kanagawa (JP)

( * ) Notice: Subject to any disclaimer, the term of this patent is extended or adjusted under 35 U.S.C. 154(b) by 1281 days.

(21) Appl. No.: 11/813,915

(22) PCT Filed: Dec. 27, 2005

(86) PCT No.: PCT/JP2005/023879

§ 371 (c)(1),
(2), (4) Date: Aug. 21, 2007

(87) PCT Pub. No.: WO2006/075522

PCT Pub. Date: Jul. 20, 2006

(65) Prior Publication Data

US 2009/0014406 A1 Jan. 15, 2009

(30) Foreign Application Priority Data

Jan. 17, 2005 (JP) ..... 2005-009332

(51) Int. Cl.
*B65D 39/00* (2006.01)

(52) U.S. Cl. ..... 215/297; 215/247; 215/334; 220/255.1; 220/258.4; 220/278

(58) Field of Classification Search ..... 215/247, 215/257, 297, 329, 334, 335, 355; 220/255.1, 220/258.4, 277, 278
See application file for complete search history.

(56) References Cited

U.S. PATENT DOCUMENTS 2,771,218 A * 11/1956 Henderson ..... 222/83
3,109,562 A * 11/1963 Ferris ..... 222/81
3,182,858 A * 5/1965 Beaudoin ..... 222/83
3,454,196 A * 7/1969 Hazard ..... 222/83
4,238,042 A * 12/1980 Hatakeyama et al. ..... 215/334
4,307,821 A * 12/1981 McIntosh ..... 222/83
4,678,098 A * 7/1987 Oka ..... 220/289
4,790,453 A * 12/1988 Fontana et al. ..... 222/83

(Continued)

FOREIGN PATENT DOCUMENTS

JP U 04-109044 9/1992

(Continued)

*Primary Examiner* — Anthony Stashick
*Assistant Examiner* — Christopher McKinley
(74) *Attorney, Agent, or Firm* — Knobbe Martens Olson & Bear LLP

(57) ABSTRACT

A bottle container in which sealing of the opening of a container body filled with a chemical liquid etc. and installation of a shoulder part, an unsealing member, and a cap can be made at the same time and that has a shoulder part fall-off prevention mechanism. A bottle container (1) has a container body (2) having a hollow cylindrical neck (21) whose upper part is open and having a step formed on a container body shoulder; a shoulder part (3) screwed on the outer peripheral surface of the neck (21) and having on its upper surface a hollow cylindrical body (32) that has a spout at its head; a cap (4) screwed on the outer peripheral surface of the hollow cylindrical body (32) and having a spout sealing means; and an unsealing prevention member (5) installed between the shoulder par (3) and the cap (4). A projection-like reversing prevention member (38) is formed on the lower surface of the shoulder part (3), and the reversing prevention member (38) and the step of the container shoulder are in contact with each other in the direction in which reversing is impossible, forming a reversing prevention means.

6 Claims, 7 Drawing Sheets

U.S. PATENT DOCUMENTS

| | | | | |
|---|---|---|---|---|
| 4,867,326 | A * | 9/1989 | O'Meara | 215/250 |
| 5,052,589 | A * | 10/1991 | O'Meara | 222/83 |
| 5,590,798 | A * | 1/1997 | O'Connell | 215/48 |
| 6,705,462 | B2 * | 3/2004 | Kasuya | 206/222 |
| 7,188,750 | B2 * | 3/2007 | Vogel et al. | 222/83 |
| 7,325,676 | B2 * | 2/2008 | Galaz Rodriguez | 206/219 |
| 7,607,549 | B2 * | 10/2009 | Morini | 215/297 |

FOREIGN PATENT DOCUMENTS

| | | |
|---|---|---|
| JP | U 06-35158 | 5/1994 |
| JP | 11-049168 | 2/1999 |
| JP | 11-236064 | 8/1999 |
| JP | 2001-018974 | 1/2001 |
| JP | 2001-171716 | 6/2001 |
| JP | 2002-059956 | 2/2002 |

* cited by examiner

[FIG. 1]
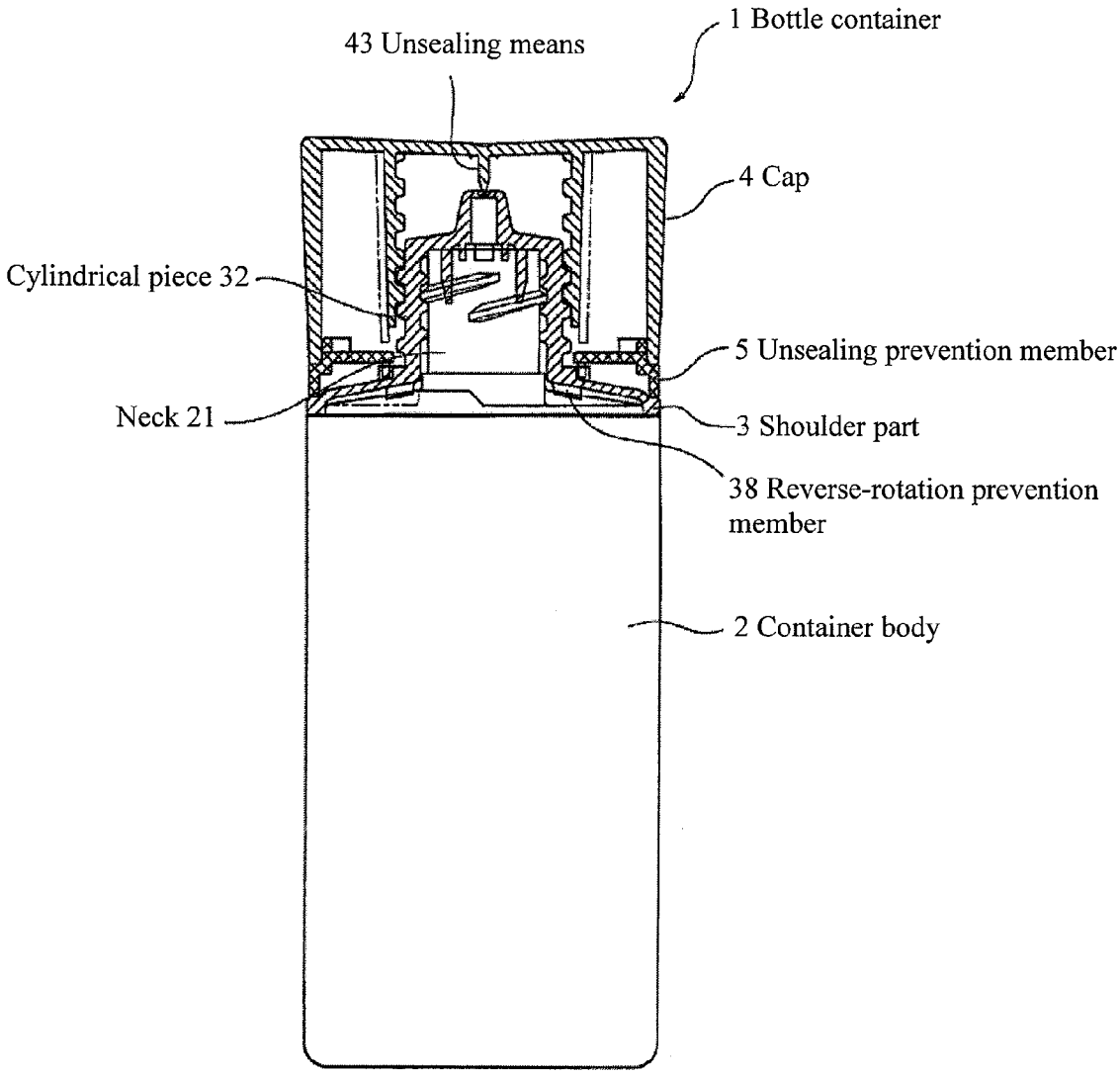

[FIG. 2]
(a)
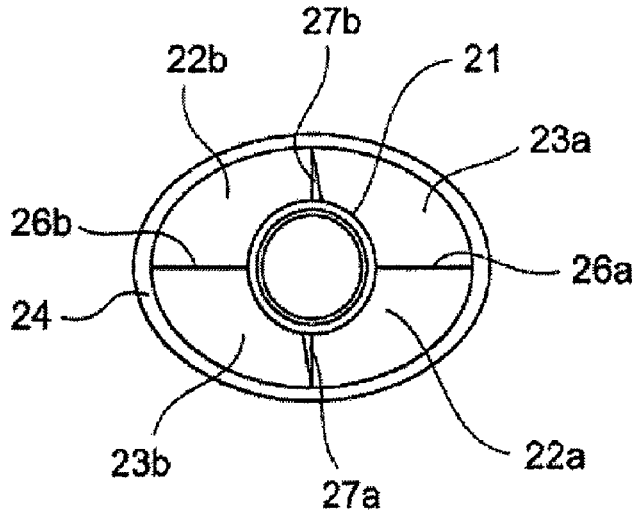
(b)
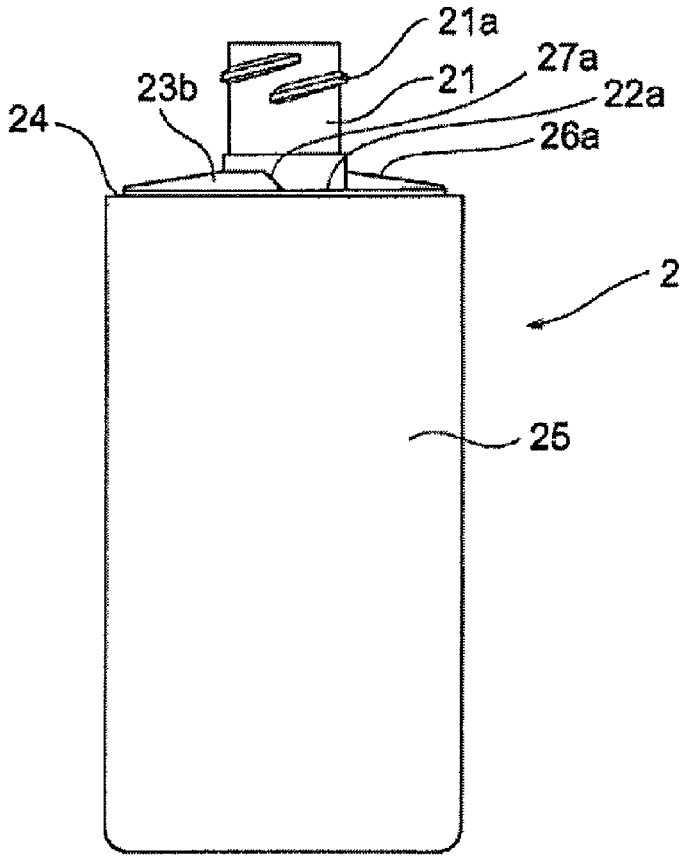

[FIG. 3]
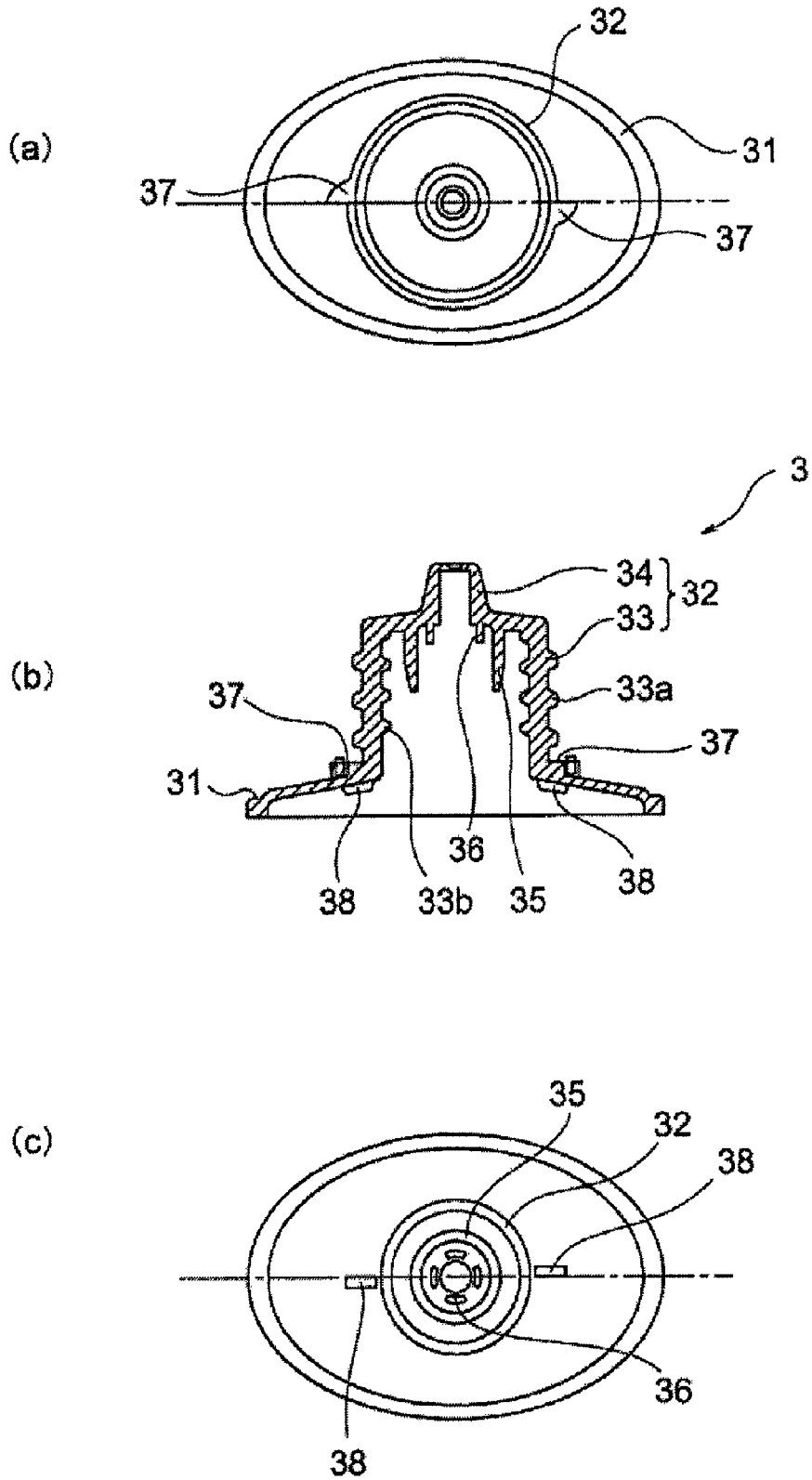

[FIG. 4]
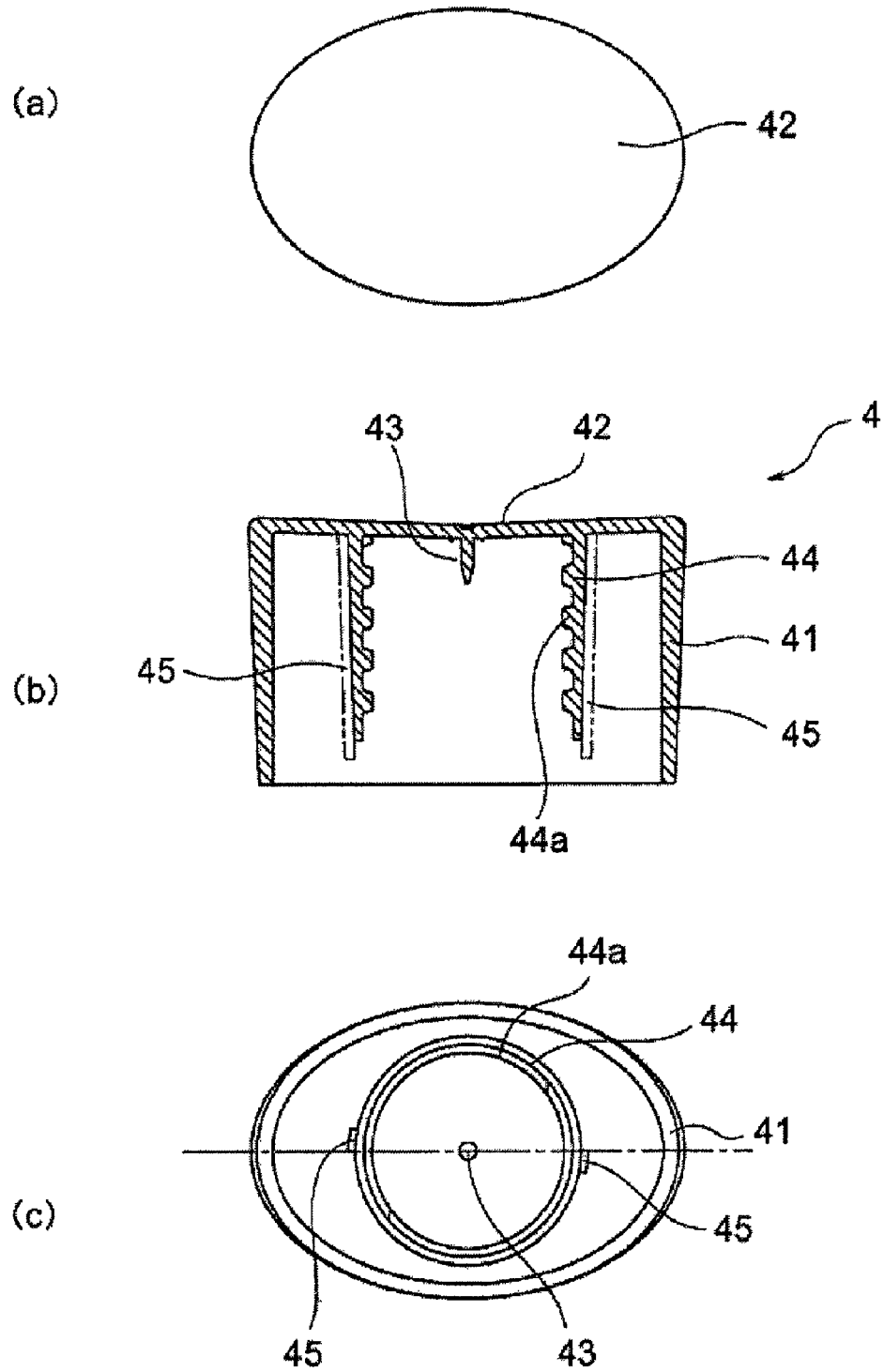

[FIG. 5]
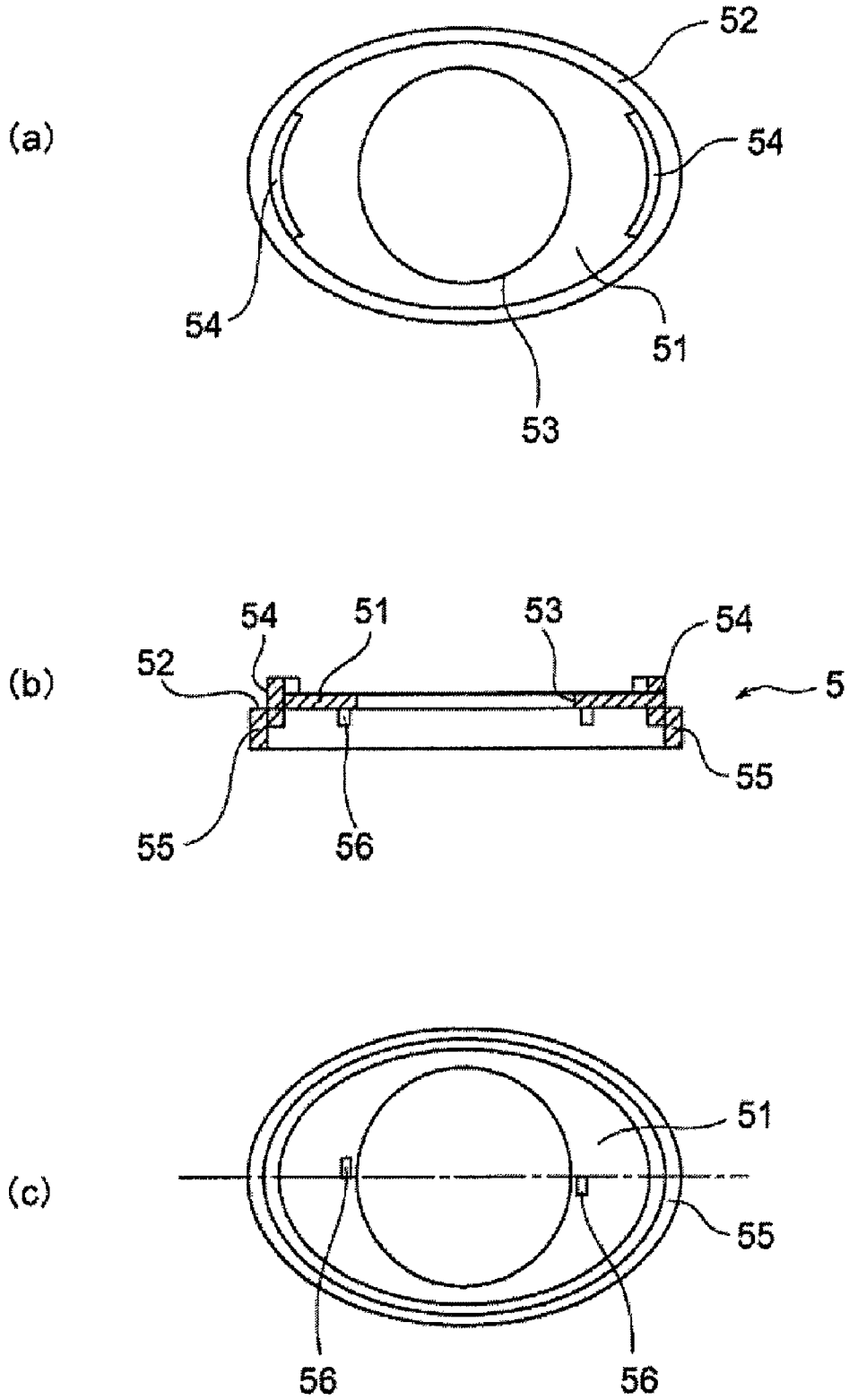

[FIG. 6]
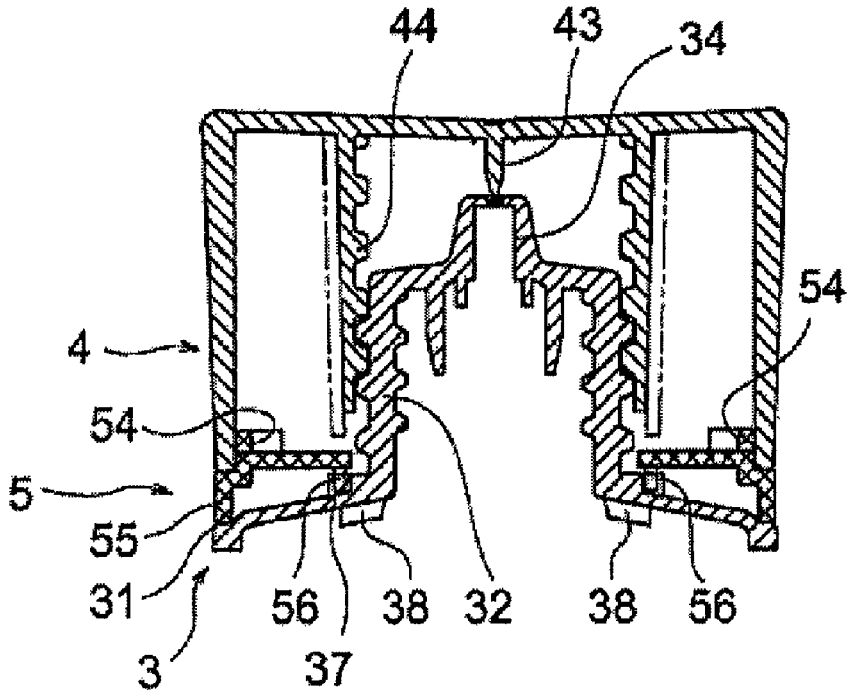
[FIG. 7]
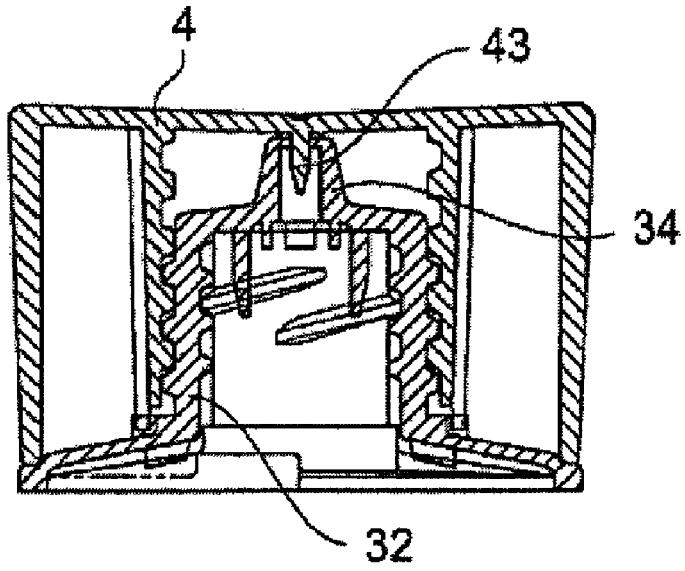

[FIG. 8]
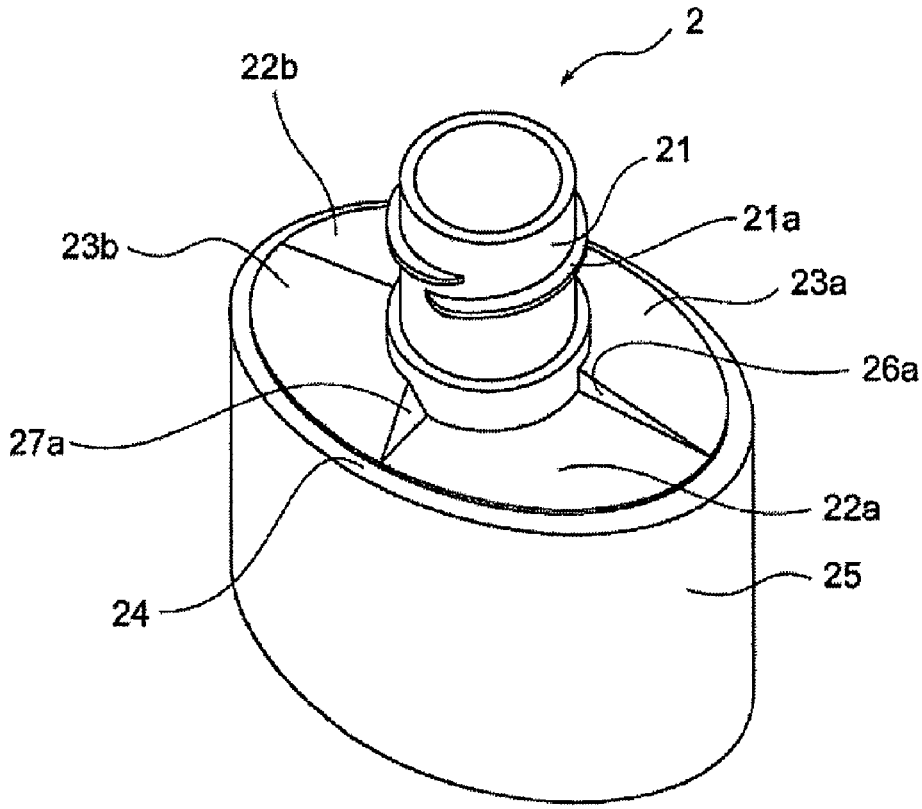

BOTTLE CONTAINER

This application is the U.S. National Phase under 35 U.S.C. §371 of International Application PCT/JP2005/023879, filed Dec. 27, 2005, which claims priority of Japanese Application No. 2005-009332, filed Jan. 17, 2005. The International Application was published under PCT Article 21(2) in a language other than English.

FIELD OF THE INVENTION

The present invention relates to a bottle container equipped with an unsealing prevention member and having a shoulder part installed on the container body.

PRIOR ART

Traditionally, containers are equipped with an unauthorized unsealing prevention member at the cap to allow the consumer to easily check whether the container has been unsealed or not. With containers, particularly containers for cosmetic products and others for which an esthetically pleasing look is important, a shoulder part is also installed on the container body to enhance the appearance and add to design versatility.

Among such bottle containers having an unsealing prevention member and shoulder part is one constructed in such a way that an engagement piece is integrally formed in the outward projecting direction of a cap, via a connection piece separably formed, around the periphery of the fitting-side opening of the cap that is attachably/detachably screwed onto a neck formed in a manner protruding from a shoulder of the container, and a shoulder part is provided on the shoulder in such a way that the shoulder part is installed separately from the cap, and while concealing the engagement piece on the screwed-in cap, engages with the engagement piece from the screw-in direction of the cap so that the engagement piece is maintained on the shoulder when the cap is detached, while allowing the connection piece to be separated. (Refer to Patent Literature 1.)

Specifically, the bottle container disclosed therein has a function to prevent unauthorized unsealing of the container, with which even when a non-circular member (shoulder part) is used as a component of the container the member needs not be adjusted for orientation to maintain a good appearance of the container, wherein an engagement piece F is integrally formed in the outward projecting direction of a cap C, via a connection piece 21 separably formed, around the periphery of the fitting-side opening of the cap C that is attachably/detachably screwed onto a neck 5 formed in a manner protruding from a shoulder 3 of a container body B of the bottle container, and a shoulder part P is provided on the shoulder 3 in such a way that the shoulder part P is installed separately from the cap, and while concealing the engagement piece F on the screwed-in cap C, engages with the engagement piece F from the screw-in direction of the cap C so that the engagement piece F is maintained on the shoulder 3 when the cap C is detached, while allowing the connection piece 21 to be separated.

The aforementioned bottle container uses the separable connection piece provided on the cap as an unsealing prevention member. There is another type of container having an unsealing prevention member separately from the cap, where the container comprises a container body whose content outlet is sealed with a sealing film; a cap having an unsealing means for opening the outlet by piercing the sealing film on the container body when the container is unsealed, and installable onto the container body in a manner covering the open outlet in the container body; and an unsealing prevention member disposed between the cap body and container body and preventing the unsealing means from piercing the sealing film. (Refer to Patent Literature 2.)

Patent Literature 1: Japanese Patent Laid-open No. 2001-18974

Patent Literature 2: Japanese Patent Laid-open No. Hei 11-236064

DISCLOSURE OF THE INVENTION

Problems to Be Solved by the Invention

However, the bottle container disclosed in Patent Literature 1 has marks of the connection piece left at the bottom of the cap after the container has been unsealed and the connection piece has been separated, and they can reduce the esthetically pleasing look of the cap. In applications where the cap is not circular and a cylindrical piece to be screwed onto the container body must be provided separately, it is difficult to provide an unsealing prevention member mentioned above. Also, the engagement piece is concealed by the shoulder part and therefore whether the container has been unsealed or not cannot be identified from the outside. In addition, the opening at the neck of the container body may have a separate pouring cover having a formed pouring opening, in which case four processes of filling the solution, installing the pouring cover, installing the shoulder part and installing the cap are required and consequently the process becomes complex.

Also with the container disclosed in Patent Literature 2 where the unsealing prevention member is provided separately from the cap, there are no longer the problems presented by the unsealing prevention member formed integrally with the bottle container as mentioned above, because the unsealing prevention means is separate from the cap. However, attachment of a sealing film at the opening, installation of the unsealing prevention member, and installation of the cap, must be performed independently after a reagent or other content has been filled into the container, which makes the process complex. Furthermore, no ingenuity has been incorporated for identifying the assembly position of each member.

Virgin seal is one type of sealing film that can be attached. However, virgin seal can be removed and then bonded again by heat treatment, and thus is unable to fully assure the unopened condition.

As long as the opening was sealed during the molding process, it is impossible to seal the opening to restore the initial state once the hole has been opened, which is desirable for assuring the unopened condition. In this case, with a tubular container according to Patent Literature 2 it is possible, as it is a usual practice, to fill the content from the bottom of the container and then heat-seal the bottom after the filling. With a bottle container, however, the content cannot be filled from the bottom, unlike with a tubular container, and therefore use of the technology disclosed in Patent Literature 2 is difficult.

The technical problem to be solved by the present invention is to provide a bottle container having an unsealing prevention member separately from the cap so that the unsealing prevention member must be removed to unseal the container before the content can be used, wherein the opening in the container body can be sealed simultaneously with the installation of the shoulder part, unsealing prevention member and cap after the container body has been filled with a reagent, etc., and wherein the bottle container also has a mechanism to prevent detachment of the shoulder part.

Means for Solving the Problems

The present invention is a bottle container comprising a container body having a cylindrical neck with an opening at the top; a shoulder part having on its top face a cylindrical piece that is screwed onto the outer periphery of the neck; a cap that has an unsealing means and is screwed onto the outer periphery of the cylindrical piece; and an unsealing prevention member disposed between the shoulder part and cap; wherein a reverse-rotation prevention means is provided for the engagement relationship of the shoulder part and container body so that the two will remain affixed and connected stably once screwed in, while there is also a structure to seal the tip of the cylindrical piece. This way, the present invention fundamentally solves the aforementioned problem and also provides an advanced invention having new components.

The key means for solving the problem, as incorporated into the present invention, are as follows:

(1) A bottle container comprising at least four members including a container body, a shoulder part, a cap and an unsealing prevention member, where the shoulder part is screwed onto the container body and the cap is screwed in via the unsealing prevention member, when the container is not unsealed;

wherein the container body comprises a cylindrical neck with an opening at the top and having a male thread formed on it, a large-diameter solution storage section, and a shoulder that connects the neck to the solution storage section, with the shoulder having a step;

wherein the shoulder part comprises a cylindrical piece having a male thread on its outer periphery and a female thread on its inner periphery and also formed with a pouring outlet having a sealed tip, and a widening section continuing from the cylindrical piece, with a projection-like member provided on the bottom face of the widening section in such a way that the projection-like member engages with the step on the shoulder;

wherein the cap has an unsealing means for opening the seal at the pouring outlet, and a female thread; and wherein the unsealing prevention member is a plate-shaped short cylinder with an opening formed at the center, where its thickness is sufficient to allow the unsealing prevention member to function as a spacer to prevent the unsealing means from contacting the pouring outlet.

(2) A bottle container according to (1), wherein the step is provided in one to four locations on the shoulder of the container body, while the projection-like member is provided in one to four locations on the bottom face of the widening section of the shoulder part.

(3) A bottle container according to (1) or (2), wherein a step is formed on the periphery of the top face of the three members, namely the container body, shoulder part and unsealing prevention member, while the inner periphery of the three members, namely the shoulder part, unsealing prevention member and cap, is formed in a manner engaging with the step, and the strength of engagement between the unsealing prevention member and shoulder part is set to the minimum.

(4) A bottle container according to any one of (1) to (3), wherein the outer shape of the container is non-cylindrical, such as an oval cylinder.

(5) A bottle container according to any one of (1) to (4), wherein the ceiling face of the cylindrical piece on the shoulder part is formed to an appropriate depth that allows the ceiling face to contact the top periphery of the opening at the neck of the container body when the shoulder part is assembled onto the container body, so as to prevent excessive rotation.

(6) A bottle container according to any one of (1) to (5), wherein a projection is formed on the top face of the widening section of the shoulder part, while a projection is formed on the bottom face of the unsealing prevention member and/or inside the cap, and the two projections maintain a position relationship that allows the rising faces of both to make contact with each other at the end of tightening by means of screwing.

EFFECTS OF THE INVENTION

The present invention has the following effects, which are unique to the present invention, through the constitutions described above:

1. The unsealing prevention member is positioned between the cap and shoulder part and the cap and shoulder part are installed, as an integral component connected via screwing, onto the container body already filled with a reagent, which enables a single assembly process.
2. The shoulder part and container body are engaged with each other based on a structure that inhibits reverse rotation, so once the shoulder part is installed onto the container body it will never rotate together with the cap, but will remain firmly affixed on the container body. Since the reverse-rotation prevention member also serves as a positioning means for the shoulder member, no positioning means is necessary to maintain a good appearance of the container.
3. A shoulder part that integrally covers from the tip with a sealed pouring opening until the shoulder of the container body has been realized.
4. Whether or not the container has been unsealed can be clearly identified based on presence or absence of the unsealing prevention member and presence or absence of an opening. Also, the cap does not fracture when it is opened, and remains clean. Additionally, the four members allow various decorative designs to be added to the bottle container, which enhances the esthetically pleasing look of the bottle.
5. A structure that allows the four members to be positioned for connection, even when the container has a non-cylindrical shape, has been realized. In particular, there are no limitations on the shapes of the cap and unsealing prevention member, which increases design flexibility.
6. The bottle container proposed by the present invention demonstrates high liquid-leak prevention capability and effectively prevents leaks even when the container is carried around by the user.
7. The shoulder part is not removable, which enables full assurance of the unopened condition.

BRIEF DESCRIPTION OF THE DRAWINGS

[FIG. 1] Front view of a bottle container according to an example of the present invention, with a part of the container shown in a section view

[FIG. 2] Top view (a) and front view (b) of a container body according to an example of the present invention

[FIG. 3] Top view (a), longitudinal section view (b) and bottom view (c) of a shoulder part according to an example of the present invention

[FIG. 4] Top view (a), longitudinal section view (b) and bottom view (c) of a cap according to an example of the present invention

[FIG. 5] Top view (a), longitudinal section view (b) and bottom view of an unsealing prevention member according to an example of the present invention

[FIG. 6] Drawing showing a cap assembled with an unsealing prevention member and shoulder part

[FIG. 7] Longitudinal section view showing an unsealed state of a bottle container according to an example of the present invention

[FIG. 8] Perspective view of a container body according to an example of the present invention

DESCRIPTION OF THE SYMBOLS

1 - - - Bottle container
2 - - - Container body
21 - - - Neck
21*a* - - - Male thread
22*a*, 22*b* - - - Flat shoulder section
23*a*, 23*b* - - - Inclined shoulder section
24 - - - Step
25 - - - Storage section
26*a*, 26*b* - - - Vertical step
27*a*, 27*b* - - - Tapered step
3 - - - Shoulder part
31 - - - Step
32 - - - Cylindrical piece
32*a* - - - Male thread
32*b* - - - Female thread
33 - - - Cylinder section
34 - - - Nozzle section
35 - - - Short cylinder
36 - - - Ball retainer
37 - - - Projecting bar
38 - - - Reverse-rotation prevention member
4 - - - Cap
41 - - - Periphery wall
42 - - - Bottom
43 - - - Unsealing means
44 - - - Cylindrical piece
44*a* - - - Female thread
45 - - - Bar piece
5 - - - Unsealing prevention member
51 - - - Flat section
52 - - - Step
53 - - - Opening
54 - - - Projecting bar
55 - - - Outer periphery cylinder
56 - - - Projection

BEST MODE FOR CARRYING OUT THE INVENTION

The bottle container proposed by the present invention comprises at least four members, including a container body, a shoulder part, a cap and an unsealing prevention member. While the container is not unsealed, the shoulder part is screwed onto the container body, and the cap is screwed in via the unsealing prevention member. When the container is unsealed, the cap and unsealing prevention member are removed and the cap is reinstalled to allow for retrieval and use of the content.

The material filled into the container body is a liquid, or specifically a cosmetic, reagent, etc.

The content is filled into the container body through the opening at the top of the container body, and then the three members, namely the shoulder part, unsealing prevention member and cap, are assembled and the assembly member is installed onto the filled container body, in order to complete an unopened bottle container filled with a cosmetic, etc.

This bottle container incorporates ingenuities for accurately determining the assembly positions of respective members and firmly connecting the members. As for the container body and shoulder part, for example, an anti-loosening mechanism is provided to prevent the two, after having been tightened and assembled, from rotating together with the cap when the cap is opened, and a mechanism to prevent excessive rotation due to over-tightening is also provided. According to the basic constitution, the shoulder part and unsealing prevention member are held by means of screwing of the cap onto the shoulder part. Furthermore, the facing sides of the shoulder part and unsealing prevention member have a projecting contact member, respectively, which provides a mechanism for positioning in the tightening direction. The cap is screwed onto the shoulder part over the unsealing prevention member that functions as a spacer.

The ingenuous engagement structure is designed so that when the container is unsealed, only the cap is removed, or both the cap and unsealing prevention member are removed, based on strength of relative engagement between the two.

The container shape, including the shapes of the container body, shoulder part, unsealing prevention member and cap, is not specifically limited. For example, the container body may have a circular, oblong, polygonal or other lateral cross-section shape, and the cap may have the same shape as, or a different shape from, the container body. Since the present invention can be applied to non-circular containers having an oval or other lateral cross-section over the entire container, adjusting the outer profiles of the respective members relatively identical is desirable because the bottle container can have an integral appearance.

The shape of each member is explained below.

The container body comprises a cylindrical neck with an opening at the top and having a male thread formed on it, a large-diameter solution storage section, and a shoulder that connects the neck to the solution storage section.

Basically the shoulder is formed roughly flat, and the flat section has one to four stair-like steps. Due to these stair-like steps, when the container is assembled, each projection-like member provided on the bottom face of the shoulder part goes over the high side of the stair and drops onto the step, so that even when a reverse rotation force is applied the wall face of the step remains in contact with the projection-like member of the shoulder part to prevent reverse rotation. These steps also regulate the assembly position of the shoulder part and container body. The contact length between the step wall and projection-like member is determined within the range of elastic deformation of the shoulder and shoulder part on the container body. Synthetic resins are primary materials for these members.

If a thread is to be provided at the neck, normally the injection molding die for the container body is split into two parts in the longitudinal direction of the container. If these two-piece split dies are used to provide a step on the shoulder, it must be positioned along the mating faces or in the moving direction so as not to obstruct the movement of the dies. Accordingly, a step is provided at one to four positions, where the respective positions are offset by 90 degrees.

A step can also be provided around the periphery of the shoulder of the container body. This step around the periphery of the shoulder rubs against the periphery of the widening section of the shoulder part to enhance the reliability of connection between the two members. Particularly when the container has an oval shape, etc., this connection affixes the connection position of the two members.

Desirably the neck should be just long enough to contact the ceiling of the cylindrical piece of the shoulder part.

Since the content is filled through the cylindrical opening at the neck, and taken out through a small nozzle-like hole when used, a pouring outlet cover or other part is provided on traditional containers, as explained in Patent Literature 1. Under the present invention, however, such pouring outlet cover is not provided separately, but it is integrally formed with the shoulder part. Accordingly, some ingenuity must be incorporated to prevent the liquid from leaking through the opening at the neck. One means for doing this is to design the outer periphery of a short cylinder in a manner suspending from the ceiling of the cylindrical piece of the shoulder part, to contact the inner wall of the neck of the container. Also, the length of the neck or that of the cylindrical piece of the shoulder part may be adjusted so that the opening at the neck will be sealed by the ceiling of the cylindrical piece. The two means may also be combined.

If the container is designed in such a way that the projection-like member on the bottom face of the widening section of the shoulder part will contact the wall face of the step on the shoulder of the container body when the shoulder part is screwed in and the ceiling of the cylindrical body of the shoulder part makes contact with the periphery of the opening at the neck, the tightening of the shoulder part can be regulated by contact with the periphery of the opening, while reverse rotation is also prevented by the step on the container body. As a result, a firm connection free from looseness can be achieved. If the container has a non-cylindrical shape such as oval, the connection stability is enhanced further by the engagement with the step around the outer periphery of the shoulder of the container body. In other words, the risk of content leak is further reduced.

The container body should be made of a rigid synthetic resin. Although the shoulder and neck must have a certain level of rigidity, the liquid storage section may be made of a soft resin.

The shoulder part comprises a cylindrical piece having a male thread on its outer periphery and a female thread on its inner periphery and also formed with a pouring outlet having a sealed tip, and a widening section continuing from the cylindrical piece, with a projection-like member provided on the bottom face of the widening section in such a way that the projection-like member engages with the step on the shoulder of the container body.

The shoulder part under the invention described in the present application for patent has, as functional components, a part that seals the opening in the container body and provides a hole from which to take out the content as well as a part at which to install the cap. In addition, the shoulder part holds the unsealing prevention member disposed between itself and the cap when the container is not unsealed. Furthermore, under the present invention the takeout hole is sealed when the container is not unsealed.

To prevent leakage of liquid in a more reliable manner, a short cylinder whose diameter is reduced by the thickness of the neck of the container body is provided at the ceiling of the cylindrical piece of the shoulder part. With this constitution, creation of any gap due to deformation of the two, or for other reason, can be flexibly addressed. To be specific, the top edge of the cylinder at the neck of the container body is held between the inner periphery wall of the cylindrical piece of the shoulder part and this short cylinder, which allows the applicable members to remain in contact. In addition, the length of the cylindrical piece of the shoulder part or that of the neck of the container body can be set in such a way as to cause the container body and the periphery of the opening to make contact, as mentioned above, as a means for ensuring the contact between the two.

The outer periphery of the cylindrical piece forms a male thread to which the cap is installed.

Provided at the tip of the cylindrical piece is a pouring outlet covered with a weakly formed seal. Since the present invention adopts the unsealing prevention member that functions as a spacer, the through member provided on the inner face of the cap does not contact the pouring outlet when the container is not unsealed, which means that the liquid will not leak when the container is not unsealed. A through hole is formed only at the start of the container unsealing process. Specifically, a needle-like projection is formed inside the cap to serve as a puncturing apparatus, and when the unsealing prevention member is removed and the cap is screwed again, this projection breaks the weak seal and a through opening is created.

The pouring outlet is formed as a small hole or as a hole at the tip of a conical projection shape. It is desirable that the outer face of the pouring outlet make contact with the inner face of the cap after puncturing, so that tight-sealing can be maintained. The needle-like projection provided on the cap also contributes to the improvement of tight-sealing action because it enters the through hole.

The shoulder part is designed so that a widening section is constituted below the cylindrical piece to allow for installation on the shoulder of the container body. The outer periphery of the widening section is aligned with the outer periphery of the shoulder of the container body.

Provided on the bottom face of this widening section is a projection-like member that contacts the step on the shoulder of the container body and demonstrates a reverse-rotation prevention function. This projection-like member is provided at one to four locations. If provided at two or more locations, the respective positions are offset by 180 or 90 degrees. One or two projections may also be added on the top face of the widening section. These projections function as stoppers to prevent the unsealing prevention member or cap from turning. Alternatively, a positioning concave shape may be provided to allow it to engage with a convex shape provided on the mating member.

A step may be formed around the top periphery of this widening section to be engaged with the unsealing prevention member or the bottom periphery of the cap installed above. If the container has a non-circular shape such as oval, this engagement demonstrates a lateral detent function to affix the engagement position of the top and bottom.

The entire widening section has a disk shape with a somewhat bulging center. This section should be made of an elastic material and formed to an appropriate shape so that when installed, it will deform slightly to be affixed in an appropriate position.

The shoulder part should be affixed strongly with the container body in a manner free from looseness, where a strong affixing design should be ensured to prevent the shoulder part and container body from turning together with the unsealing prevention member or cap installed above.

The cap has an unsealing means for opening the seal at the pouring outlet, and a female thread.

A needle-like or conical projection is provided as the unsealing means. When the unsealing prevention member is removed to use the content, this projection enters the sealed pouring outlet at the shoulder part, punctures the seal, and thereby allows the content to be taken out.

When the cap is closed, the unsealing means remains inside the pouring outlet, which helps prevent leakage of liquid. Also, the height of the inner face of the cap may be set in such a way that the inner face will contact the pouring outlet after the seal is punctured, in order to prevent the content from leaking when the bottle topples. A ring-like embankment may also be formed around the pouring outlet to further improve the leakage protection action.

The cap is basically connected with the shoulder part by means of screwing. Positioning may be achieved by the thread design, but further ingenuities may be added to improve the accuracy of the tightening position and reliability of lock to prevent excess turning and loosening. One such ingenuity is to provide a projection-like member that serves as a stopper, when the cap is tightened, by contacting the projection provided on the top face of the widening section of the shoulder part. If a concave shape is formed in the top face of the widening section of the shoulder part, this projection is designed to enter the concave shape to affix the cap in position.

In an assembled/installed state, the bottom edge of the shoulder part makes direct contact with the top face of the shoulder of the container body, which increases the tightening resistance and thereby prevents excessive tightening. This structure also demonstrates a positioning function.

If a step is provided on the top periphery of the shoulder part or unsealing prevention member, this step may be set to engage with the bottom periphery of the cap. If the container has a non-circular shape such as oval, an engaged state based on the above structure also serves as a positioning function. A step on a non-circular shape receives a force to cancel engagement in the initial stage of opening action, and therefore this force must be made smaller than the engaging force between the shoulder part and container body. Specific means to do this include making the step shallow and forming an outward-opening gradual taper shape around the bottom periphery of the cap.

Ensuring strong engagement of the cap and preventing it from loosening in a tightened state is an important factor of leak prevention, particularly for cosmetic containers carried around by users.

The unsealing prevention member is a plate-shaped short cylinder with an opening formed at the center, where its height is sufficient to allow the unsealing prevention member to function as a spacer to prevent the unsealing means from contacting the pouring outlet. The unsealing prevention member used in the present invention remains visible so that whether the container is unsealed or not can be readily identified and is removed before use. For this reason, the outer periphery is engaged with the shoulder part at the bottom, while the top is aligned or engaged with the cap.

The strength of engagement with the cap is adjusted in such a way as to allow the unsealing prevention member to detach together with the cap, or allow only the cap to detach, when the container is unsealed for the first time. If the container has a cylindrical shape, causing only the cap to detach is easy. If the container has a non-circular shape such as oval, a deep step can be formed around the top periphery to increase the engaging force with the cap and thereby allow the unsealing prevention member to detach together with the cap. Furthermore, the periphery wall may be raised from the step to the long side to enhance the engaging force.

To allow for identification of the tightening position, a projection that contacts the projection at the top of the widening section of the shoulder part may also be provided on the bottom face.

The material may be either a metal or synthetic resin. However, synthetic resins are more preferable.

The bottle container proposed by the present invention allows the top members, comprising the integrally formed shoulder part, unsealing prevention member and cap, to be assembled in a single process after the content has been filled into the container body.

Integration of the top members can be achieved by assembling the cap with the unsealing prevention member and then screwing the assembly onto the shoulder part. This integration can be performed immediately after the manufacturing process of each container part, which means that the integral top members can be assembled simultaneously onto the container body in the process where the content is bottled.

In this case, or specifically in the process of assembling the integral top members onto the container body, the contact between the projection provided on the top face of the widening section of the shoulder part and the projection provided on the bottom face of the unsealing prevention member, as well as the contact between the projection provided on the top face of the unsealing prevention member and the projection provided below the cap, both serve as a means for transmitting a force in the tightening direction, which is needed to integrally assemble the top members or assemble the integral members onto the container body.

Preferably the bottle container should be made of a synthetic resin, or in particular a hard synthetic resin. As for the installation of the shoulder part, the shoulder of the container, or the widening section of the shoulder part, or both, must undergo elastic deformation to fit into the engaging position. Accordingly, at least one should undergo a greater elastic deformation than the other. The material of the cap should be preferably harder than the material of the shoulder part, or more preferably a synthetic resin having sufficient hardness to puncture the sealed pouring outlet.

EXAMPLE

A bottle container according to an example of the present invention is explained using FIG. 1 through FIG. 8.

FIG. 1 is a front view of a bottle container according to this example of the present invention, with a part of the container shown in a section view. FIG. 2 provides a top view (a) and front view (b) of the container body. FIG. 3 provides a top view (a), longitudinal section view (b) and bottom view (c) of the shoulder part. FIG. 4 provides a top view (a), longitudinal section view (b) and bottom view (c) of the cap. FIG. 5 provides a top view (a), longitudinal section view (b) and bottom view (c) of the unsealing prevention member. FIG. 6 shows the integral top members comprising the cap, unsealing prevention member and shoulder part. FIG. 7 is a longitudinal section view of the bottle container in an unsealed state. FIG. 8 is a perspective view of the container body.

The bottle container in this example is made of a synthetic resin and its entire structure is hard. In this example, the shoulder part is formed using a slightly softer material, and is structured so that when installed onto the container body the widening section of the shoulder part undergoes elastic deformation to be assembled/installed. The cap is formed using a material harder than that of the shoulder part, and is structured so that it can puncture the seal at the pouring outlet.

As shown in FIG. 1, a bottle container 1 according to this example comprises a container body 2 having a cylindrical neck 21; a shoulder part 3 installed on the top face of the container body 2 and having a cylindrical piece 32 that is screwed onto the outer periphery of the cylindrical neck 21; a cap 4 screwed onto the outer periphery of the cylindrical piece 32 and having an unsealing means 43; and an unsealing prevention member 5 disposed between the shoulder part 3 and cap 4.

As shown in FIG. 2, the container body 2 has an oblong lateral cross-section having a storage section 25, and the cylindrical neck 21 is projecting at the center of the top face. The top of the neck 21 is open, and a male thread 21*a* is formed around its periphery. Also provided on the top face in an alternating manner are two flat shoulder sections 22, as well as two inclined shoulder sections 23 inclining from the base of the neck 21 toward the periphery. On the periphery, there is a step 24 that contacts, when the shoulder part 3 is installed, the bottom face of a step provided on the periphery of the shoulder part 3. The boundary between the flat shoulder section 22 and inclined shoulder section 23 is formed in a stair-like shape. In this example, however, tapered steps 27*a*, 27*b* are formed as stairs on the shorter side in such a way that the projections on the shoulder part side are guided toward and go over the tapered steps at the time of tightening. On the other hand, vertical steps 26*a*, 26*b* constituting vertical walls are provided as stairs on the longer side at the right and left, so that when a reverse-rotation prevention member 38 on the shoulder part side drops onto the vertical step, a large resistance generates to prevent the shoulder part from detaching and thereby prevent reverse rotation.

FIG. 8 is a perspective view of the container body 2, providing an outline of the shoulder shape of the container.

As shown in FIG. 3, the shoulder part 3 is a slightly bulging shallow, hollow disk with the step 31 around its periphery. A cylindrical piece 32 having a plate-like part on the outside is projecting at the center of the hollow structure, as if to cover the neck of the container, where this cylindrical piece 32 covers the top face of the container body 2 and has an outer profile that is roughly the same as that of the container body 2. The step 31 is made shallow to achieve a weak engagement with the end of the cap 4, and its side face creates a convex arc.

The cylindrical piece 32 comprises a cylinder section 33, and a cylindrical nozzle 34 that is projecting from, and formed integrally with, the cylinder section 33 and having its tip sealed weakly. A male thread 33*a* to screw the cap is formed around the outer periphery of the cylinder section 33, while the inner face has a female thread 33*b* to screw the neck 21 of the container body 2. The interior of the cylinder section 33 also has a short cylinder 35 that enters the opening at the neck 21 and contacts the neck 21 when the neck 21 of the container body 2 is screwed onto the cylinder section 33. Provided on the inside of this short cylinder 35 is a ball retainer 36 running along the opening that connects to the nozzle section 34. The ball retainer 36 is provided so that the ball placed inside the container for agitation purpose will not contact the back of the opening to inhibit pouring of the content.

Provided on the top face of the shoulder part 3 are two projecting bars 37, 37 running in point symmetry along the base of the cylinder section 33, while the inner surface has two reverse-rotation prevention members 38, 38 constituted by projecting plates running in point symmetry that are designed, when the shoulder part 3 is screwed onto the container body 2, to work with the vertical steps 26*a*, 26*b* on the top face of the container body 2 to prevent rotation in the reverse direction (removal direction).

As shown in FIG. 4, the cap member 4 is a cylinder with a bottom, having an oblong lateral cross-section and a periphery wall 41 that expands toward the open end. Provided at the center of a bottom 42 on the inner face is the conical projection 43 that functions as an unsealing means, and a cylindrical piece 44 is provided around this conical projection 43. Formed on the inner periphery of the cylinder piece 44 is a female thread 44*a* screwed onto the cylinder section 33 projecting from the shoulder part 3. The length of the cylindrical piece 44 is shorter than the length of the periphery wall 41 of the cap 4, and two bar pieces 45, 45 extending in point symmetry from the end are provided on the outer periphery of the cylindrical piece 44 so that when the unsealing prevention member 5 is removed and the cap 4 is screwed onto the shoulder part 3, they will contact the two projecting bars 37, 37 provided at the base of the cylindrical piece 32 of the shoulder part 3 to prevent excessive tightening.

The bottom periphery of the periphery wall 41 of the cap contacts the step 31 provided on the periphery of the shoulder part. In this example where the container has a non-circular shape, a strong engaging force can be achieved, and consequently firm connection and anti-loosening effect.

As shown in FIG. 5, formed on the unsealing prevention member 5 are an oblong flat section 51 and a step 52 around the outer periphery, and an opening 53 is provided at the center of the flat section 51 to allow for insertion of the cylindrical piece 32 of the shoulder part 3.

Projecting on both ends of the top face of the flat section 51 in the longitudinal direction are projecting arced bars 54, 54 that run along the step 52 and correspond to the inner face of the cap. Provided below the step 52 is an outer periphery cylinder 55 that will serve as a spacer, when the cap 4 is installed onto the container body 2, to prevent the conical projection 43 on the cap 4 from entering, or opening, the sealed nozzle section 34 at the shoulder part 3.

Also provided on the inner face of the flat section 51 near the opening 53 are two projections 56, 56 running in point symmetry, which will contact the two projecting bars 37, 37 provided along the base of the cylinder 31 of the shoulder part 3 when the cap 4, unsealing prevention member 5 and shoulder part 3 are integrated and installed onto the container body 2, to prevent the shoulder part from spinning.

The bottom periphery of the outer periphery cylinder 55 is provided in such a way that it contacts and engages with the step 31 of the shoulder part 3.

Next, the assembly procedure of the bottle container in this example is explained. FIG. 6 shows the top members, namely the cap 4, unsealing prevention member 5 and shoulder part 3, in an integrated state.

First, the unsealing prevention member 5 is inserted through the opening end of the cap 4, to cause the step 52 around the periphery of the unsealing prevention member 5 to contact the opening end of the cap 4, and also cause the projecting arced bars 54, 54 provided on the top face to engage with the cap 4 and thereby fit with the cap 4 in an non-rotatable manner. Next, when the cylindrical piece 32 of the shoulder part 3 is screwed onto the cylindrical piece 44 of the cap 4 through the opening 53 in the unsealing prevention member 5, the bottom periphery of the outer periphery cylinder 55 of the unsealing prevention member 5 contacts the step 31 of the shoulder part 3, while the projections 56, 56 on the bottom face of the unsealing prevention member 5 engage with the projecting bars 37, 37 provided along the base of the cylinder section of the shoulder part, to prevent rotation. Because of this, the cap 4 is screwed in a manner in which the tip of the conical projection 43 provided in the cap 4 does not enter the tip of the nozzle section 34 of the shoulder part 3, i.e., in a manner in which unsealing is inhibited.

As explained above, the cap 4 and shoulder part 3 are integrally assembled by sandwiching the unsealing prevention member 5 between them (refer to FIG. 6), and therefore when the cap 4 integrated with the shoulder part 3 and unsealing prevention member 5 is screwed onto the neck 21 of the container body 2 after a reagent, etc., has been filled into the container body 2, the shoulder part 3 undergoes elastic deformation while the bottom edge of the outer periphery of the shoulder part 3 remains in contact with the top surfaces of the inclined shoulder sections 23*a*, 23*b* on the container body 2, thereby causing the plate-like reverse-rotation prevention members 38, 38 projecting from the shoulder part 3 to drop onto the vertical steps 26*a*, 26*b*, while at the same time the bottom of the outer periphery of the shoulder part 3 contacts the step 24 on the shoulder of the container body 2, and all members are positioned and installed in their respective positions.

To prevent position offset due to excessive tightening, the inner depth of the cylindrical piece 33 is set in such a way that the cylindrical piece 33 functions as a restricting member, with the inner ceiling of the cylindrical piece 33 stopping upon contacting the top edge of the neck of the container body. Since the bottom edge of the outer periphery of the shoulder part 3 contacts the step 24 on the container body 2, the downward movement of the shoulder part due to screwing action is inhibited by a resistance force, which prevents position offset due to excessive tightening.

When the bottle container 1 thus assembled is used, the cap 4 is turned in the direction of removal from the container body 2. Since the unsealing prevention member 5 is installed onto the cap in a non-rotatable manner, the unsealing prevention member 5 is detached together with the cap 4. At this time, the reverse-rotation prevention members 38, 38 on the shoulder part 3 contact the shoulder 23 of the container body 2, thereby remaining installed onto the container body 2 without rotating together with the cap 4. Since the container has an oval shape, the above also provides a detent effect. Next, the unsealing prevention member 5 is pulled out from the cap 4, and then the cap 4 is screwed onto the cylindrical piece 32 of the shoulder part 3 again. This way, the bottom edge of the periphery wall 41 of the cap contacts the step 31 provided around the periphery of the shoulder part 3, and the bar pieces 45, 45 extending from the cylindrical piece 44 of the cap 4 make contact with the projecting bars 37, 37 provided along the base of the cylindrical piece of the shoulder part 3 to stop further screw-in action. At this time, the conical projection 43 punctures the seal 34*a* at the tip of the nozzle section 34, as shown in FIG. 7, to open the nozzle section.

Next, the cap 4 is turned in the direction of removal. Since the step 31 on the shoulder part 3 is shallow, a convex arc is formed on the side face, and the periphery wall 41 of the cap 4 is tapered, the engagement of the shoulder part and cap is separated and the cap becomes removable.

To dispose of the container after use, the shoulder part 3 is turned with a strong force in the direction of removal, to cause the reverse-rotation prevention members 38, 38 to undergo elastic deformation and go over the vertical steps 26*a*, 26*b* on the container body 2, or the shoulder of the container body is fractured. Either way, the engagement of the container body 2 and shoulder part 3 is separated and the shoulder part 3 becomes removable.

For your reference, in this example the outer periphery of each part is designed in a natural shape so that they look the same or continue seamlessly.

As explained above, the bottle container proposed by the present invention comprises a container body having a cylindrical neck with an opening at the top; a shoulder part having on its top face a cylindrical piece that is screwed onto the outer periphery of the neck; a cap that has an unsealing means and is screwed onto the outer periphery of the cylindrical piece; and an unsealing prevention member disposed between the shoulder part and cap; wherein the shoulder part has on its bottom face a reverse-rotation prevention means for preventing reverse rotation when the shoulder part is screwed onto the container body, while the tip of the cylindrical piece is sealed, so that the opening in the container body can be sealed simultaneously with the installation of the shoulder part and cap after the container body has been filled with a reagent, etc. The four members can be designed smoothly as if they were formed integrally, and the container maintains a clean appearance because no marks remain after the unsealing prevention member has been removed. This makes it possible to design a very esthetically pleasing design. After use, the individual parts can be separated for classification/collection by material, which makes the present invention a recyclable container having less negative impact on the environment.

The invention claimed is:

1. A bottle container comprising:

a container body comprising (i) a cylindrical neck with an opening at its top and having a male thread formed therearound, (ii) a large-width non-cylindrical fluid storage section having a width larger than the cylindrical neck, and (iii) a shoulder that connects the neck to the fluid storage section, said shoulder having steps with risers both extending in a radial direction on its outer surface and having an outer periphery non-cylindrical recess formed inwardly from an outer periphery of the non-cylindrical fluid storage section;

a shoulder part comprising (i) a cylindrical piece having a male thread on its outer periphery and a female thread on its inner periphery closer to the center of the shoulder part than is the outer periphery of the shoulder part and having a pouring outlet with a sealed tip, and (ii) a widening section continuing from the cylindrical piece and having (iia) projection-like members provided on its bottom face for engaging with the steps with risers on the shoulder of the container body and (iib) an outer periphery non-cylindrical projection for engaging and fitting with the outer periphery non-cylindrical recess of the shoulder when the female thread of the cylindrical piece and the male thread of the cylindrical neck are engaged, said outer periphery non-cylindrical projection having an outer periphery corresponding to that of the outer periphery non-cylindrical recess of the shoulder;

a cap having an unsealing member for piercing the sealed tip at the pouring outlet, and a female thread for engaging with the male thread of the cylindrical piece, said cap having a non-cylindrical outer portion having an outer periphery corresponding to the outer periphery of the shoulder part; and an unsealing prevention member which is a plate-shaped non-cylindrical member with an opening formed at its center through which the shoulder part is inserted to interpose the unsealing prevention member between the cap and the shoulder part when the pouring outlet is not unsealed, where the unsealing prevention member has an outer periphery recess for engaging and fitting with the outer portion of the cap, and has a thickness sufficient to allow the unsealing prevention member to function as a spacer to prevent the unsealing member of the cap from contacting the sealing tip of the pouring outlet.

2. The bottle container according to claim 1, wherein the steps of the shoulder are inclined toward the outer periphery non-cylindrical recess.

3. The bottle container according to claim 1, wherein the steps and risers of the shoulder consist of two steps each having two risers.

4. The bottle container according to claim 1, wherein the non-cylindrical fluid storage, the widening section of the shoulder part, the non-cylindrical outer portion of the cap, and the non-cylindrical unsealing prevention member are oval-shaped.

5. The bottle container according to claim 1, wherein the shoulder part has projecting bars at a bottom of the cylindrical piece, and the cap has an inner portion having the female thread and having bar pieces at a bottom of the inner portion for engaging with the projecting bars of the shoulder part.

6. The bottle container according to claim 5, wherein the unsealing prevention member has projections on its bottom face near the opening for engaging with the projecting bars of the shoulder part.

* * * * *